US006136041A

United States Patent [19]

Jaschinski et al.

[11] Patent Number: 6,136,041

[45] Date of Patent: Oct. 24, 2000

[54] METHOD FOR BLEACHING LIGNOCELLULOSIC FIBERS

[76] Inventors: Thomas Jaschinski, Kanalstrasse 8, D-23552 Lübeck; Rudolf Patt, Buchtallee 14a, D-21465 Reinbeck, both of Germany

[21] Appl. No.: 09/171,229

[22] PCT Filed: Apr. 14, 1997

[86] PCT No.: PCT/EP97/01865

§ 371 Date: Dec. 30, 1998

§ 102(e) Date: Dec. 30, 1998

[87] PCT Pub. No.: WO97/39179

PCT Pub. Date: Oct. 23, 1997

[30] Foreign Application Priority Data

Apr. 13, 1996 [DE] Germany ..... 196 14 587

[51] Int. Cl.[7] ..... D06L 3/02; D21C 9/16

[52] U.S. Cl. ..... 8/111; 162/78

[58] Field of Search ..... 8/111; 162/78

[56] References Cited

U.S. PATENT DOCUMENTS 5,630,906 5/1997 Boe et al. .

FOREIGN PATENT DOCUMENTS 2040617 7/1995 Russian Federation .

*Primary Examiner*—Margaret Einsmann
*Attorney, Agent, or Firm*—Herbert Dubno

[57] ABSTRACT

A method of bleaching lignocellulosic fibers is disclosed which comprises the step of treating the lignocellulosic fibers with a bleaching composition comprising at least one oxidizing bleaching agent in aqueous solution in the presence of at least one additive which activates delignification or bleaching wherein the activating additive is a phenanthroline selected from the group consisting of 2,9-dimethyl-1,10-phenanthroline, 2,9-dimethyl-4,7-diphenyl-1,10-phenanthroline, 2,9-dimethyl-4,7-diphenyl-1,10-phenanthroline-disulfonic acid-disodium salt-hydrate, and 3,4,7,8-tetramethyl-1,10-phenanthroline.

18 Claims, No Drawings

METHOD FOR BLEACHING LIGNOCELLULOSIC FIBERS

FIELD OF THE INVENTION

The invention relates to a method for the bleaching of lignocellulosic fibers wherein lignocellulosic fibers are treated with at least one oxidizing bleaching chemical in aqueous solution. The invention also relates to the application of additives for bleaching lignocellulosic fibers and to the application of an aqueous solution containing at least one additive for bleaching lignocellulosic fibers.

In the context of this paper, the term "lignocellulosic fibers" includes all sorts and types of pulp like e.g. chemical and mechanical pulp, dissolving pulp or pulp prepared from waste paper but also natural fibers like cotton or flax fibers.

BACKGROUND OF THE INVENTION

Pulps produced with alkaline pulping methods, such as the Kraft method, or produced with acid pulping methods such as the acid magnesium bi-sulfite method, or with methods which use organic dissolving agents such as methanol (ORGANOSOLV™, ORGANOCELL™, ALCELL™), or with alkali pulping methods which use, in addition to aqueous alkali, sulfite, anthraquinone and/or other organic solvents such as methanol, e.g. the ASAM method (Alkali-Sulfite-Anthraquinone-Methanol) must be treated in at least one bleaching step after pulping to achieve high degrees of brightness.

The state of the art technology for the production of paper or products made from dissolving pulp is based on the use of bleached fibers containing small amounts of residual lignin. An almost completely lignin-free pulp with an $\alpha$-cellulose content of 98% is required, for example, for dissolving pulps. The fiber must also be free of lignin for chemical pulps as well. The brightness requirements for paper made from recycled fibers are also continually increasing. Fibers primarily used for the production of newspaper such as ground wood, RMP (refiner mechanical pulp), TMP (thermo mechanical pulp), and CTMP (chemo-thermo mechanical pulp) are increasingly being bleached to higher brightnesses, not only with reducing bleaching agents such as hypochlorite (HClO) and dithionite ($SO_2O_4^{-2}$) but also with oxidizing bleaching agents containing oxygen such as hydrogen peroxide. Because bleaching is no longer conducted exclusively with elemental chlorine or chlorine containing chemicals for environmental and economic reasons, chlorine-free oxidizing compounds like oxygen, ozone or peroxo-chemicals like hydrogen peroxide or peracids and mixtures thereof are used more often.

These chlorine-free chemicals comprise mainly oxidizing bleaching chemicals like oxygen, ozone and peroxo-chemicals. Among the peroxo-chemicals, peroxides, especially hydrogen peroxide is well suited to bleach lignocellulosic fibers. However, sodium hydroxide, peracids like peracetic acid, performic acid or Caroic acid and salts thereof are also suited to increase pulp brightness. The increasing trend towards the TCF (total chlorine free) bleaching of all fibrous materials for the production of paper with oxygen, ozone and chemicals containing peroxo compounds necessitates increased efforts to more efficiently utilize and activate these chemicals in the bleaching liquor, thereby attaining higher consumption and higher brightness.

It is very difficult, however, to activate hydrogen peroxide during this procedure by adding more alkali or increasing the temperature. The higher amounts of alkali or the higher temperature can greatly effect the bleaching reaction, leading to a complete consumption of the peroxide in the alkali milieu which results in secondary yellowing. (H. Süss; H. Krüger and K. Schmidt, "Die optimale Bleiche von Holzstoffen und ihre Abwasserbelastung", Papier (34), (10), 1980, pg. 433–438). Thus it has been necessary to retain a certain residual amount of peroxide in the alkali fiber suspension after bleaching to avoid brightness reversion after final bleaching of the fibers.

Peroxide bleaching of fibrous materials used for the production of chemical and dissolving pulps has become a normal practice today. Almost all types of pulps can be bleached at least in single bleaching steps with an alkaline peroxide solution (P stage), often a P-stage is used for brightening the pulp to final brightness in the final bleaching step. Even during prebleaching, delignifying treatment with oxygen (alkaline oxygen stage), increased brightness is attained by adding hydrogen peroxide. Pulps finally bleached with hydrogen peroxide demonstrate, however, a decreased brightness reversion compared to pulps bleached with a CEDED-sequence by application of elemental chlorine (C), alkaline extractions (E) and chlorine dioxide (D).

For the most part, it is impossible to attain a pulp brightness above 80% ISO for softwood pulps produced with the alkaline sulfate method (also known as the Kraft method) by TCF bleaching without using ozone and higher dosages of hydrogen peroxide which is not economical. Lab studies have reported on multistage bleaching methods which, with the exclusive use of 7% of hydrogen peroxide, attained a brightness of 88% ISO. These studies are described in "The optimal conditions for P* hydrogen peroxide bleaching" by Desprez, J. J. Devenyns and N. A. Troughten Proc. Pulping Conf. San Diego 929–934 (1994). However, cost of bleaching chemicals is extremely high for this bleaching sequence.

In order to improve the effect of bleaching of peroxo-compounds, efforts have been made to stabilize said peroxo-compounds, i.e. to prevent decomposition of e.g. hydrogen peroxide in the bleaching liquor. Known additives e.g. for stabilizing hydrogen peroxide are sodium silicate, EDTA or DTPA.

Bleaching is usually conducted in several stages. Between these stages the pulp is washed on washing filters. Because of the presence of heavy metal ions in the pulp, which were incorporated into the wood during growth, a chelation should be conducted before peroxide bleaching to reduce catalytic decomposition of peroxide. Chelation is conducted in a separate process step at temperatures between 50–90° C. and under slightly acidic reaction conditions, e.g. pH level between 4–6 with soluble chelating agents such as EDTA (Ethylene Diamine Tetraacetic Acid) or DTPA (Diethylene Triamine Pentaacetic Acid), followed by washing. It can also be conducted at acid pH levels between 2–4 with sulfuric acid and at higher temperatures. In the following washing step the acid must be completely removed.

OBJECTS OF THE INVENTION

The objective of this invention is to present a method as described in the introduction which allows making improved use of chlorine-free peroxo-chemicals. This objective is attained according to the invention by treating lignocellulosic fibers with at least one oxidizing bleaching agent in aqueous solution in the presence of at least one additive which activates bleaching; the additive being chosen among the 2,9-dimethyl-1,10-phenanthroline and/or its N-oxide and/or its metal complexes, 2,9-dimethyl-4,7-diphenyl-1,10-phenanthroline (bathocuproine) and/or its N-oxide and/ or its metal complexes, 2,9-dimethyl-4,7-diphenyl-1,10-phenanthroline-disulfonic acid-di-sodium salt-hydrate (bathocuproindisulfonic acid disodium salt) and/or its N-oxide and/or its metal complexes and 3,4,7,8-tetramethyl-1,10-phenanthroline and/or its N-oxide and/or its metal complexes.

The further objective of this invention is to provide chemicals or mixtures of chemicals suitable for application in pulp bleaching. This objective is attained by providing additives in solid or liquid form for application in bleaching of lignocellulosic fibers.

SUMMARY OF THE INVENTION

As outlined above, oxidizing bleaching chemicals are subject to catalytic decomposition. The loss of bleaching chemicals due to catalytic decomposition adds further to the already high cost of chlorine-free oxidizing bleaching chemicals. A first approach to solve this problem was an attempt to remove metal ions by either acid washing or by masking the metal ions by means of chelation. However, decomposition is still very high, especially if hydrogen peroxide is applied. Therefore, it is still desired to improve stabilizing of oxidative bleaching chemicals. The term "stabilizing" is used in the context of this disclosure if an increase in residual amount of oxidizing bleaching chemical is observed.

However, the present invention does not primarily deal with stabilization of oxidizing bleaching chemicals. Instead, it is proposed to enhance the brightening effect of oxidizing bleaching chemicals by adding activating additives chosen among the phenanthrolines cited above to the bleaching solution. In the context of this disclosure, "activation" refers to an additional increase in brightness of the fibers treated under oxidizing bleaching conditions.

If the method according to the invention is applied, it is possible to positively activate e.g. the hydrogen peroxide to bleach the lignocellulosic fibrous material to a higher degree of brightness. Through this activation an exceptional brightness increase is attained, resulting thereby in a greatly improved efficiency of the peroxide bleaching, just by adding an activating additive chosen among the phenanthrolines cited above. Thus the inventive method allows to either reduce the input of oxidative bleaching chemicals or to increase the brightness of the fibers. These positive effects can be observed with additives containing diimine-groups, preferably alpha-alpha-diimine bondings.

Each of these aspects is economically interesting. Reduction of chemical input leads to a reduction of cost of production while increased brightness of fibers allows demanding higher prices for the final product. Besides, the reduction of chemical input implies positive effects with respect to environmental issues. Surprisingly, another advantage of applying activating additives is that they enhance delignification. A reduced content of lignin is closely related to fiber brightness, especially to the degree of final brightness which might be attained after the bleaching process is completed. Thus, the delignifying effect of the activating additives contributes to pulp brightness not only by increasing the efficiency of the oxidizing bleaching chemical but also by supporting pulp delignification.

The invention relates specifically to the application of an activating additive to solutions for bleaching lignocellulosic fibers under oxidizing conditions. Such mixtures improve the efficiency of oxidizing bleaching chemicals, especially of peroxo-compounds suitable to bleach lignocellulosic fibrous material to produce chemical or dissolving pulps. This activating additive comprises at least one activating additive chosen among the phenanthrolines as cited in claim 1. The positive effects of such mixtures have been described above.

Phenanthrolines and polypyridyles are environmentally feasible compounds. They decompose if the residual bleaching liquor is burnt after bleaching or if the residual bleaching liquor is subjected to biological or chemical wastewater-treatment.

The method according to the invention works for oxidizing bleaching chemicals suited for bleaching of lignocellulosic fibers. It works especially if oxygen, ozone or peroxo-chemicals are applied. Among the peroxo-chemicals, the results achieved in hydrogen peroxide bleaching are very favorable. Here, brightness increase is very high, especially in final bleaching stages. Further, in hydrogen peroxide bleaching (P stages), final brightness is higher than without application of activating additives. However, similar effects can be obtained in sodium peroxide bleaching, in bleaching with perborates, peracetic acid or caroic acids and/or salts thereof like e.g. sodium caroate.

Although application of single additives results in the desired effect of improved brightness of fibers, it is impossible to combine two or more of said activating additives to maximize he brightening effect. Surprisingly, repeated use of said activating additives proves to be beneficial. If a bleaching sequence comprises for example two or more P stages, an additional brightening and/or delignifying and/or stabilizing effect will be observed in each peroxide stage. This is astonishing because usually, the effect of additives is exhausted after one application.

Although the activating effect is said to be characteristic of the phenanthrolines in general because all of them contain diimine structures, some specific substances proved to be especially effective. These specific substances are 2,9 dimethyl-1,10-phenanthroline, 2,9-dimethyl-4,7-diphenyl-1,10-phenanthroline (bathocuproine), 2,9-dimethyl-4,7-diphenyl-1,10-phenanthroline-disulfonic acid disodium salt hydrate (bathocuproinedisulfonic acid disodium salt) and 3,4,7,8-tetramethylene-1,10-phenanthroline.

Further, N-oxides (nitrogen oxides) and/or metal ion complexes of the aforementioned phenanthrolines have proven to be especially useful in activating oxidizing bleaching chemicals.

The activating additives are applied at an amount of 0.001 to 5% of additive based on bone dry lignocellulosic fiber. The preferable dosage ranges from 0.01 to 1.0% of additive based on bone dry lignocellulosic fiber. This dosage balances brightness improving effect and additional cost of additive within acceptable limits.

The oxidizing bleaching chemical is applied in an amount of 0.1 to 15% of bleaching chemical based on bone dry lignocellulosic fiber. For economical reasons it is preferred to limit the use of oxidizing bleaching chemicals to 0.5 to 7.0%, even more preferred is a maximum of 5% of bleaching chemical based on bone dry lignocellulosic fiber.

The activating effect of the aforedescribed additives does not depend on the pH conditions of the bleaching process. Brightness increase is observed under acidic, neutral and alkaline conditions. However, very favorable results have been achieved within the pH range from 8 to 13.5. The activating additives are not sensitive with respect to the alkali source which is used for pH adjustment. All known alkali sources may be applied, for example sodium hydroxide, magnesium oxide, potassium hydroxide or the like. The alkali dosage ranges preferably from 1.0% to 5.0% based on bone dry fiber.

The activating additives are not sensitive to extreme reaction conditions. Brightness increase of fibers is observed even if bleaching is conducted at high temperatures. Thus, an improved pulp brightness can be achieved if bleaching is carried out within the temperature range of 20° C. to 130° C. However, it is preferred to conduct pulp bleaching at temperature from 40° C. to 80° C. Reaction may take from 5 to 420 minutes, depending on the specific requirements of the lignocellulosic material to be bleached. It was very unexpected to find that delignification occurred under these mild bleaching conditions. Usually, the structure of residual lignin, especially of Kraft pulps, is described as not accessible due to its high content of condensed components. An additive which is able to render residual lignin accessible for oxidizing agents is thus very much appreciated.

The method according to the invention does not depend on the consistency of the bleaching solution. The content of bone dry lignocellulosic fibers may range from 0.5 to 50% based on water.

The method according to the invention does not depend on the solvent used for bleaching of lignocellulosic fibers. If alcohol is added to the aqueous bleaching solution, the increase of brightness is not affected. The method works even if bleaching is carried out in pure alcoholic solvent. Bleaching in aqueous-alcoholic medium results in improved viscosity of the fibers.

Surprisingly, the activating additives showed a certain stabilizing effect. The residual amount of oxidizing bleaching chemical was higher, if an activating additive was applied. The stabilizing effect is much appreciated because less bleaching chemical is required. Nevertheless, it is considered as an advantage that the activating additives can be applied together with other stabilizing compounds. As outlined above, stabilizing compounds are frequently used to prevent decomposition of oxidizing bleaching chemicals. Often combination of additives of different structure results in counterproductive effects. However, if the method according to the invention is applied, stabilizing compounds may be added without adversely affecting the brightening and/or delignifying effect of the phenanthrolines.

Thus a preferred embodiment of the method according to the invention comprises the joint application of activating additives together with stabilizing compounds. Preferred stabilizing compounds are e.g. poly-alpha-hydroxyacrylic acid, phosphonic acid and its derivative like e.g. diethylentriaminpentakismethylenephosphonic acid (DTPMPA), or 1-hydroxyethan-1,1-diphosphonic acid, polyaminocarboxylic acid, nitrilotriacetic acid (NTA), salicylic acid, salts of these acids, oxi- or polyoxi-compounds with 2 to 7 carbon atoms in their carbon atom chain, magnesium sulfate or sodium silicate. Further, magnesium ions may be added to the bleaching solution. Any known source of Mg-ions may be used like e.g. magnesium oxide, magnesium heptahydrate or magnesium sulfate. These stabilizing compounds may be applied either singularly or in combination. Especially stabilizing compounds comprising a phosphonic acid component are suited to stabilize oxidizing bleaching agents, like e.g. aminotrismethyl-phosphonic acid (ATMP), ethylenediamine-tetrakismethylenephosphonic acid (EDTMPA), triethylenetetraminhexakis methylenephosphonic acid (TTHMP), 2-phosphonobutane-1,2,4-tricarbonic acid (PBTC), 1-hydroxyethane-1,1-diphosphonic acid (HEDP), and/or N-(1-carboxymethyl)1-amino-ethane-1, 1diphosphonic acid (CADP) as well as their N-oxides and/or their salts, respectively.

An improved method according to the invention comprises the preparation of an aqueous or aqueous-alcoholic mixture of the activating additive or additives and the stabilizing compound or compounds and applying this mixture to the solution of lignocellulosic fibers and oxidizing bleaching chemicals. The positive effect of adding the mixture is not impaired if the mixture is added before, together with or after the bleaching chemical. Adding said mixture reduces handling of fiber bleaching components and allows making maximum use of the expensive oxidizing bleaching chemicals.

Lignocellulosic fibers treated with oxidizing bleaching chemicals in the presence of an activating additive showed a reduced "yellowing", i.e. a reduced brightness reversion after prolonged exposition to light. This, too, is a commercially attractive aspect because brightness stability is a parameter of fiber quality and thus an argument in pricing and it enlarges the range of applicability for fiber products.

The phenanthrolines as listed are well suited to activate peroxide due to their stability at higher temperatures and under alkaline and oxidizing conditions.

The advantages which result from the efficient hydrogen peroxide bleaching can be summarized as follows. Bleaching times can be shortened by activating the hydrogen peroxide through the addition of the bleaching activation agents. In addition the use of ecologically questionable and highly poisonous bleaching chemicals such as chlorine, and chemicals containing chlorine such as chlorine dioxide and hypochlorite, is no longer necessary.

The use of the activating additive is explained in the following examples. While the examples indicate preferred reaction conditions, other methods of application are possible and obvious to the expert skilled in the art.

EXAMPLE 1

Peroxide Bleaching (P-stage) of a Pre-delignified Kraft Spruce Pulp (example for reference only)

Example 1 demonstrates the considerable improvement of brightness of the bleached pulp and an improved efficiency of the use of hydrogen peroxide obtained when using 1,10-phenanthroline (T6 and T7) or 2,2'-bipyridyl (T8 and T9) as compared to the blind trial $T_1$. In the following, reaction conditions and results are described in detail.

Pre-Bleaching

The Kraft spruce pulp was subjected to an alkali/oxygen delignification (O-stage) and an acid washing treatment (A) afterwards. In the alkaline oxygen stage (O), the pulp slurry (10% consistency) was treated for 140 minutes in an electrically heated, rotating, steel autoclave with an aqueous alkali bleaching liquor, consisting of 2.75% NaOH, and 1.0% $MgSO_4$, at 110° C. and 0.8 Mpa. Pressure was adjusted by adding oxygen to the autoclave. In the second treatment step (A-stage), the pulp was adjusted in de-ionized water to a consistency of 3%, and the pH level was reduced to 2 with concentrated sulfuric acid. The pulp was treated for 30 minutes at 70° C. All of the acid was then washed out of the pulp in a final step. The thus pre-treated pulp was the pulp used in the following peroxide bleaching stage.

The viscosity (T230), the kappa number (T246 and Zellcheming Merkblatt IV/37/63), and the brightness (T217) were determined according to the corresponding test methods of the 'Technical Association of the Pulp and Paper Industry' (TAPPI) or according to the regulations of the Zellcheming pamphlet. After the alkali/oxygen treatment (O) and an acid treatment (A), the pulp had a kappa number of 7.6 and a brightness of 42.3% ISO.

Peroxide Bleaching (P)

The chemicals listed in the table 1 were added to the aqueous pulp suspension at a consistency of 10%. The amount of chemicals was calculated on bone dry (bd) fiber mass.

The alkali pulp suspension was then put in an autoclave lined with polytetrafluoroethylene (PTFE) and adjusted to temperature in a silicon oil bath.

At the end of the reaction the residual amount of peroxide in the filtrate of the alkaline bleaching liquor was determined idiometrically in % based on the bd fiber mass. The pulp was washed, and the brightness was determined according to the methods described above. Unless otherwise mentioned, this procedure was maintained for all following examples.

Table 1 presents the parameters and results of T1–T9 of the P-stage.

TABLE 1

| | T1 | T2 | T3 | T4 | T5 | T6 | T7 | T8 | T9 |
|---|---|---|---|---|---|---|---|---|---|
| Temperature (° C.) | 120 | 120 | 120 | 120 | 120 | 120 | 120 | 120 | 120 |
| Time (min) | 80 | 80 | 80 | 80 | 80 | 80 | 80 | 60 | 60 |
| $MgSO_4$ | 0.5 | 0.5 | 0.5 | 0.5 | 0.5 | 0.5 | 0.5 | 0.5 | 0.5 |
| NaOH | 1.5 | 1.5 | 1.5 | 1.5 | 1.5 | 1.5 | 1.5 | 1.5 | 1.5 |
| $H_2O_2$ | 3.0 | 3.0 | 3.0 | 3.0 | 3.0 | 3.0 | 3.0 | 4.0 | 4.0 |
| DTPMP (%) | — | 0.01 | 0.03 | 0.02 | 0.05 | 0.05 | 0.05 | — | — |
| HEDP (%) | — | 0.001 | 0.003 | 0.002 | 0.005 | 0.005 | 0.005 | — | — |
| Na-Gluconate | — | 0.25 | 0.75 | 0.50 | 1.25 | 1.25 | 1.25 | — | — |
| 1,10-phenanthroline (%) | — | — | — | — | — | 0.10 | 0.20 | — | — |
| 2,2'-bipyridyle (%) | — | — | — | — | — | — | — | — | 0.2 |
| $H_2O_2$ at end of reaction (%) | 0.17 | 0.77 | 0.77 | 0.82 | 1.36 | 1.22 | 1.00 | 1.72 | 0.22 |
| Kappa number (–) | — | — | — | — | — | — | — | 4.8 | 3.1 |
| Brightness (% ISO) | 71.3 | 71.9 | 75.0 | 73.6 | 74.5 | 81.2 | 82.5 | 75.8 | 83.5 |

T1 shows the effect of hydrogen peroxide bleaching without adding additives. Brightness increases from initially 42.3% ISO to 71.3% ISO. If stabilizing agents are applied (T2 to T5), brightness increases further by another 0.6 to 3.2% ISO. Application of 0.1% or 0.2% activating additive (1,10-phenanthroline) causes another increase in brightness from 71.3% ISO to 81.2% ISO and 82.5% ISO, respectively; see T6 and T7. However, the increase in brightness does not depend on the presence of stabilizing agents. T8 and T9 show that the application of 4% hydrogen peroxide alone results in a brightness of 75.8% ISO. If 0.2% of activating additive (2,2'-bipyridyl) is applied, brightness increases by another 7.8% ISO and the residual lignin content is reduced by 1.5 Kappa numbers. While the application of 0.2% of activating additive leads to an increase in brightness of 11.2% ISO (T1/T7) and 7.8% ISO (T8/T9), an increase of the amount of hydrogen peroxide from 3% to 4% based on bd pulp allows an increase in brightness of 4.5% ISO only.

EXAMPLE 2

Oxygen-Peroxide Bleaching (OP) of a Pre-Delignified Kraft Spruce Pulp (example for reference only)

In Example 2 the brightness increase of the pulp bleached in an OP bleaching step with the addition of 1,10-phenanthroline (T11–T13) is compared to the blind trial (T10).

Pretreatment

The treatment and properties of the pulp are the same as described in Example 1.

Oxygen Peroxide Bleaching (OP)

The chemicals listed in the table were added to the aqueous pulp suspension based on the bd fiber mass at a consistency of 10%. The alkali pulp suspension was then put in an autoclave lined with polytetrafluorethylene (PTFE) and adjusted to temperature in a silicon oil bath.

At the end of the reaction the residual amount of peroxide in the filtrate of the alkali bleaching liquor was idiometrically determined based on the bd fiber mass. The pulp was washed, and the brightness was determined according to the methods described above.

Table 2 presents the parameters and results of T10–T13 of the OP-stage.

TABLE 2

| | T10 | T11 | T12 | T13 |
|---|---|---|---|---|
| Temperature (° C.) | 120 | 120 | 120 | 120 |
| Time (min) | 80 | 80 | 80 | 80 |
| $MgSO_4$ | 0.5 | 0.5 | 0.5 | 0.5 |
| NaOH | 1.5 | 1.5 | 1.5 | 1.5 |
| $H_2O_2$ | 4.0 | 4.0 | 4.0 | 4.0 |
| DTPMP (%) | 0.03 | 0.03 | 0.03 | 0.03 |
| HEDP (%) | 0.003 | 0.003 | 0.003 | 0.003 |
| Na-Gluconate | 0.75 | 0.75 | 0.75 | 0.75 |
| 1,10-phenanthroline (%) | — | 0.10 | 0.15 | 0.20 |
| $H_2O_2$ at end of reaction (%) | 1.40 | 1.00 | 0.80 | 0.60 |
| Kappa number (–) | 3.5 | 2.7 | 2.7 | 2.5 |
| Brightness (% ISO) | 80.5 | 86.3 | 87.6 | 88.1 |

The addition of the activating additive not only caused an increase in brightness by 8% ISO but also reduced the residual lignin content. Addition of 1,10-phenanthroline improved the pulp brightness although the overall brightness level of the pulp is already high. The reduction of residual lignin content is especially remarkable because reaction conditions are quite mild compared to pulping conditions.

EXAMPLE 3

Peroxide Bleaching (P) of an OA (OP) Pretreated Kraft Spruce Pulp (example for reference only)

Example 3 demonstrates that, even with a smaller dosage of 1,10-phenanthroline and a lower bleaching temperature than in the preceding examples, it is possible to obtain greater brightness increases than in the blind trial T14 (T15–T19).

Pre-Treatment

The alkali/oxygen treatment (0) and the acid pre-treatment (A) correspond to the treatment described in Example 1. The following oxygen/peroxide bleaching was also conducted in an electrically heated rotating steel autoclave at 100° C. and at an oxygen pressure of 0.8 Mpa. 2.0% NaOH, 1.0% $MgSO_4$, 0.66% nitrilamine, and 2.0% $H_2O_2$ were added to the aqueous fibrous suspension. Bleaching time was 140 min.

After the OA (OP) pre-bleaching, the brightness of the pulp was 73.6%, the kappa number 2.6, and viscosity 761 ml/g.

Peroxide Bleaching

The following peroxide bleaching was conducted in polyethylene bags, which were adjusted to temperature in a water bath. The consistency was 10%. The chemicals added to the pulp are listed in Table 3.

At the end of the reaction the residual amount of peroxide in the filtrate of the alkali bleaching liquor was idiometrically determined based on the bd fiber mass. The pulp was washed, and the brightness was determined according to the methods described above.

Table 3 presents the parameters and results of T14–T19 of the P-stage following the pre-treatment.

TABLE 3

| | T14 | T15 | T16 | T17 | T18 | T19 |
|---|---|---|---|---|---|---|
| Temperature (° C.) | 90 | 90 | 90 | 90 | 90 | 90 |
| Time (min) | 240 | 240 | 240 | 240 | 240 | 240 |
| $MgSO_4$ | 0.5 | 0.5 | 0.5 | 0.5 | 0.5 | 0.5 |
| NaOH | 1.5 | 1.5 | 1.5 | 1.5 | 1.5 | 1.5 |
| $H_2O_2$ | 2.0 | 2.0 | 2.0 | 2.0 | 2.0 | 2.0 |
| 1,10-phenanthroline (%) | — | 0.0125 | 0.025 | 0.05 | 0.10 | 0.20 |
| $H_2O_2$ at end of reaction time (%) | 1.28 | 1.17 | 1.14 | 1.11 | 0.99 | 0.71 |
| Brightness (% ISO) | 77.3 | 79.3 | 80.4 | 81.3 | 82.3 | 82.9 |

A 2% ISO higher brightness can be obtained with just 0.0125% of additive based on the bd fiber mass. The use of 0.2% of the activating additive led to a brightness increase of approximately 6% ISO. The continuous increase in brightness indicates that a further increase in pulp brightness may be achieved by adding more activating additive. However, in order to limit cost of bleaching, the application of additive was restricted to 0.2% based on bd lignocellulosic fiber. If the price of the activating additive goes down, a higher dose of additive will allow a further increase in final pulp brightness.

EXAMPLE 4

Oxygen/Peroxide Treatment (OP) of an Unbleached, Untreated Kraft Spruce Pulp (example for reference only)

In Example 4 it is demonstrated how the use of an additive lowers the lignin content of the pulp (T21) compared to a blind trial without the additive (T20). Kappa number after pulping and prior to oxygen delignification was determined to be 22.3.

Without any pre-treatment, the Kraft spruce pulp was bleached at a consistency of 10% and at 0.8 Mpa pressure in an initial OP bleaching step in autoclaves rotated in a silicon bath heated to reaction temperature. Pressure was adjusted by adding oxygen. The chemicals listed in Table 4 were added to the pulp beforehand. The pulp was washed, and the brightness was determined according to the methods described above. In Table 4 the parameters and results of T20 and T21 are compared.

TABLE 4

| | T20 | T21 |
|---|---|---|
| Temperature (° C.) | 120 | 120 |
| Time (min) | 60 | 60 |
| $MgSO_4$ | 1.0 | 1.0 |
| NaOH | 2.75 | 2.75 |
| $H_2O_2$ | 2.0 | 2.0 |
| 1,10-phenanthroline (%) | — | 0.20 |
| Kappa number (–) | 14.2 | 13.1 |

EXAMPLE 5

Oxygen/Peroxide Bleaching (OP) of a Pretreated Kraft Hardwood Pulp (eucalyptus) (example for reference only)

In Example 5 the treatment according to the invention also demonstrates a positive effect during the bleaching of the Kraft eucalyptus pulp.

The eucalyptus pulp, industrially pre-treated by an alkali-oxygen delignification to a kappa number of 7.9, with a viscosity of 848 ml/g and a brightness of 40% ISO, was bleached further in an oxygen/peroxide bleaching step. Pressure was adjusted to 0.8 Mpa by adding oxygen. The parameters and results of the (OP) bleaching are listed in Table 5.

TABLE 5

| | T22 | T23 |
|---|---|---|
| Temperature (° C.) | 100 | 100 |
| Time (min) | 60 | 60 |
| $MgSO_4$ | 0.5 | 0.5 |
| NaOH | 1.5 | 1.5 |
| $H_2O_2$ | 4.0 | 4.0 |
| 1,10-phenanthroline (%) | — | 0.10 |
| Brightness (% ISO) | 71.6 | 78.7 |
| $H_2O_2$ at end of reaction (%) | 1.46 | 1.57 |

The chemicals listed in Table 5 were added to the aqueous fibrous suspension at 10% consistency based on the bd fiber mass. The fibrous suspension was then put into an autoclave lined with polytetrafluoroethylene (PTFE) under 0.8 Mpa and adjusted to temperature in a rotating silicon oil bath. At the end of the reaction the residual amunt of peroxide in the filtrate of the alkaline bleaching liquor was idiometrically determined based on the bd fiber mass. The pulp was washed, and the brightness was determined according to the methods described above.

Compared to Example 1, the activating additive proves to be even more efficient in bleaching hardwood pulp. Here, the stabilizing effect of 1,10-phenanthroline becomes apparent. Although brightness increased by 7.1% ISO, residual peroxide content increased, too.

EXAMPLE 6

Bleaching of Waste Paper (example for reference only)

In Example 6 the inventive method was also used to bleach a de-inked 70/30 (magazine/newspaper) mixture of waste paper pulp and also obtained very positive results.

The waste paper was only de-inked before bleaching. Neither chelation nor any other kind of pretreatment was conducted. In Table 6 the parameters and results of T24 and T25 are compared.

TABLE 6

| | T24 | T25 |
|---|---|---|
| Temperature (° C.) | 90 | 90 |
| Time (min) | 180 | 180 |
| $MgSO_4$ | 0.5 | 0.5 |
| NaOH | 2 | 1.5 |
| $H_2O_2$ | 5.0 | 5.0 |
| Sodium silicate (%) | 1.5 | 1.5 |
| DTPA (%) | 0.3 | 0.3 |
| 1,10-phenathroline (%) | — | 0.10 |
| Brightness (% ISO) | 71.3 | 72.8 |
| $H_2O_2$ at end of reaction (%) | 0.19 | 1.79 |

Even after de-inking, waste paper pulp contains an extremely high amount of impurities like ink, clay, resins and other material used in paper production and printing. Because hydrogen peroxide is highly sensitive to these compounds, decomposition is high and the brightening effect is very much limited. Although stabilizing compounds (Sodium silicate, DTPA) were added in the blind trial, too, addition of 1,10-phenanthroline proved not only to be efficient in increasing fiber brightness but also to prevent decomposition of hydrogen peroxide. The stabilizing effect of phenanthroline appears to be different from the reaction mechanism of the other stabilizing compounds and phenanthroline thus acts synergistic.

EXAMPLE 7

Oxygen/Peroxide Bleaching (OP) of an Unbleached ASAM Pine Pulp (example for reference only)

In Example 7 the method according to the invention is used to bleach a pine pulp cooked according to an alkali pulping method with anthraquinone and methanol known as ASAM.

Usually, bleaching is conducted in aqueous solutions. But also mixtures of water and alcohol, for example ethanol, methanol or butanol can be used as solvent. Bleaching in pure alcohol is possible, too. The additive acts as an activator and leads to an increase in pulp brightness. The results of Ta, Tb, Tc and Td indicate that addition of alcohol does not impair the effect of the activating additive is higher than compared to the blind trial. This holds true for bleaching in aqueous solution as well as in aqueous-alcoholic solution. It is surprising that the activating additive causes an increase in pulp brightness although the amount of alkali is rather high.

The conditions and results of the trials are listed in Table 7.

TABLE 7

| | T26 | T27 | Ta | Tb | Tc | Td |
|---|---|---|---|---|---|---|
| Temperature [° C.] | 120 | 120 | 120 | 120 | 120 | 120 |
| Time [min] | 90 | 90 | 90 | 90 | 90 | 90 |
| $MgSO_4$ [%] | 0.25 | 0.25 | 0.35 | 0.35 | 0.35 | 0.35 |
| NaOH [%] | 3.5 | 3.5 | 3.5 | 3.5 | 3.5 | 3.5 |
| $H_2O_2$ [%] | 5.0 | 5.0 | 5.0 | 5.0 | 5.0 | 5.0 |
| Methanol [%] | — | — | — | — | 0.1 | 0.1 |
| Poly-a-hydroxiacrylic acid [%] | 0.1 | 0.1 | 0.1 | 0.1 | 0.1 | 0.1 |
| 1,10-phenanthroline [%] | — | 0.1 | — | 0.1 | — | 0.1 |
| $H_2O_2$ at end of reaction [%] | 12.2 | 9.5 | 17.7 | 13.3 | 16.0 | 7.5 |
| Brightness [% ISO] | 82.5 | 84.5 | 83.5 | 85.2 | 83.6 | 85.2 |
| Viscosity [ml/g] | 964 | 795 | 946 | 798 | 1063 | 893 |

EXAMPLE 8

OP-Bleaching of a Pretreated Kraft Spruce Pulp

The pulp bleached in Example 8 was pretreated like the pulp used in Example 1. The pulp had a Kappa number of 7.5 and a brightness of 42.3% ISO prior to the OP bleaching stage. Table 8 shows reaction conditions and results of the OP bleaching stage.

2,9-dimethyl-4,7-diphenyl-1,10-phenanthroline does not only lead to a considerable increase in pulp brightness but shows also a high ability to stabilize hydrogen peroxide. Brightness increase is almost as high as with 1,10-phenanthroline but peroxide stabilization is much improved compared to 1,10-phenanthroline. 5-nitro-1,10-phenanthroline improves pulp brightness although the increase in pulp brightness is not as high as for the other additives.

TABLE 8

| | T28 | T29 | T30 | T31 | T32 | T33 | T34 |
|---|---|---|---|---|---|---|---|
| Temperature [° C.] | 120 | 120 | 120 | 120 | 120 | 120 | 120 |
| Time [min] | 60 | 60 | 60 | 60 | 60 | 60 | 60 |
| $MgSO_4$ [%] | 0.5 | 0.5 | 0.5 | 0.5 | 0.5 | 0.5 | 0.5 |
| NaOH [%] | 1.5 | 1.5 | 1.5 | 1.5 | 1.5 | 1.5 | 1.5 |
| $H_2O_2$ [%] | 4 | 4 | 4 | 4 | 4 | 4 | 4 |
| 2,9-dimethylene-4,7-diphenyl-1,10-phenanthroline [%] | — | 0.25 | — | — | — | — | — |
| 5-Nitro-1,10-phenanthroline [%] | — | — | 0.25 | 0.5 | — | — | — |

TABLE 8-continued

| | T28 | T29 | T30 | T31 | T32 | T33 | T34 |
|---|---|---|---|---|---|---|---|
| 1,10-phenanthroline [%] | — | — | — | — | 0.25 | — | — |
| phenanthrenquinone [%] | — | — | — | — | — | 0.5 | 1.0 |
| Brightness [% ISO] | 75.6 | 79.8 | 77.0 | 77.2 | 80.5 | 76.4 | 75.4 |
| $H_2O_2$ at end of reaction [%] | 29.9 | 50.2 | 27.6 | 21.7 | 24.2 | 30.2 | 30.9 |

EXAMPLE 9

Hydrogen Peroxide Bleaching of a Kraft Spruce Pulp Prebleached with Ozone (Z stage)

The pulp bleached in Example 9 originated from an industry sample and showed the following properties prior to peroxide bleaching: Kappa number 1.8; pulp viscosity 542 ml/g; brightness: 75.7% ISO.

Table 9 shows reaction conditions and results of peroxide bleaching.

Application of 4-methyl-1,10-phenanthroline causes an activation of hydrogen peroxide which is even more efficient than the activation effect of 1,10-phenanthroline. While the blind trial (T35) results in a brightness of 84.8% ISO, application of small amounts of 4-methyl-1,10-phenanthroline result in a final pulp brightness of 87.9% ISO at best. Small amounts of 1,10-phenanthroline allow a final brightness of 86.5% ISO. Results achieved with only minor amounts of activating additives showed a significant increase in brightness which could not be anticipated.

TABLE 9

| | T35 | T36 | T37 | T38 | T39 | T40 | T41 | T42 | T43 |
|---|---|---|---|---|---|---|---|---|---|
| Temperature [° C.] | 90 | 90 | 90 | 90 | 90 | 90 | 90 | 90 | 90 |
| Time [min] | 90 | 90 | 90 | 90 | 90 | 90 | 90 | 90 | 90 |
| $MgSO_4$ [%] | — | — | — | — | — | — | — | — | — |
| NaOH [%] | 1.5 | 1.5 | 1.5 | 1.5 | 1.5 | 1.5 | 1.5 | 1.5 | 1.5 |
| $H_2O_2$ [%] | 2 | 2 | 2 | 2 | 2 | 2 | 2 | 2 | 2 |
| 4-methylene-1,10-phenanthroline [%] | — | 0.025 | 0.05 | 0.075 | 0.1 | — | — | — | — |
| 1,10-phenanthroline [%] | — | — | — | — | — | 0.025 | 0.05 | 0.075 | 0.1 |
| Brightness [% ISO] | 84.8 | 86.7 | 86.9 | 87.5 | 87.9 | 86.6 | 86.4 | 86.4 | 86.5 |
| $H_2O_2$ at end of reaction [%] | 94.4 | 88.4 | 87.6 | 83.3 | 79.1 | 91.0 | 89.3 | 86.0 | 84.2 |

EXAMPLE 10

Peroxide Bleaching of an Oxygen Pretreated Kraft Spruce Pulp

The kraft spruce pulp was pretreated like the pulp described in Example 1. After oxygen pretreatment, a chelating treatment followed (Q stage). Chelation was carried out at 3% consistency and 60° C. for 60 minutes. 0.5% DTPA were applied as chelating agent.

Prior to peroxide bleaching, the pulp showed a Kappa number of 8.0; viscosity: 807 ml/g; brightness: 40.4% ISO.

TABLE 10-1

| | T44 | T45 | T46 | T47 | T48 | T49 | T50 | T51 | T52 |
|---|---|---|---|---|---|---|---|---|---|
| Temperature [° C.] | 120 | 120 | 120 | 120 | 120 | 120 | 120 | 120 | 120 |
| Time [min] | 90 | 90 | 90 | 90 | 90 | 90 | 90 | 90 | 90 |
| $MgSO_4$ [%] | — | — | — | — | — | — | — | — | — |
| NaOH [%] | 1.5 | 1.5 | 1.5 | 1.5 | 1.5 | 1.5 | 1.5 | 1.5 | 1.5 |
| $H_2O_2$ [%] | 4 | 4 | 4 | 4 | 4 | 4 | 4 | 4 | 4 |
| 3,4,7,8-tetramethylene-1,10- | — | 0.025 | 0.05 | 0.1 | 0.15 | — | — | — | — |

TABLE 10-1-continued

| | T44 | T45 | T46 | T47 | T48 | T49 | T50 | T51 | T52 |
|---|---|---|---|---|---|---|---|---|---|
| phenanthroline [%] | | | | | | | | | |
| 1,10-phenanthroline [%] | — | — | — | — | — | 0.025 | 0.05 | 0.1 | 0.15 |
| 2,2'-bipyridyle | — | — | — | — | — | — | — | — | — |
| Brightness [% ISO] | 76.5 | 79.3 | 80.7 | 81.1 | 81.7 | 78.9 | 80.2 | 81.1 | 81.4 |
| $H_2O_2$ at end of reaction [%] | 17.0 | 25.1 | 22.5 | 21.7 | 19.1 | 19.6 | 20.4 | 17.9 | 14.5 |
| Viscosity [ml/g] | 641 | 624 | 601 | 578 | 546 | 599 | 581 | 554 | 514 |

Addition of even smallest amounts of activating additives (0.025% based on bone dry fiber) leads to an increase in pulp brightness. Especially 3,4,7,8-tetramethyl-1,10-phenanthroline proves to be efficient although the brightness level of the pulp is already high. Besides its brightening effect, this additive causes a significantly reduced loss in viscosity. A reduced decrease of viscosity usually implies an increased yield because less carbohydrates have been solubilized during bleaching. Further, strength properties correlate positively with pulp viscosity. High viscosity usually indicates high pulp strength.

Example 11 shows the very favorable effect of 4-methyl-1,10-phenanthroline compared to 1,10-phenanthroline. Even the smallest amounts of 4-methyl-1,10-phenanthroline lead to considerably increased pulp brightness. When increasing the amount of additive from 0.025% to 0.15% based on bd lignocellulosic fiber, no slowing down of brightness increase can be found. Even under the mild conditions of peroxide bleaching (low temperatures), the additive causes further delignification of the pulp. Delignification, too is more efficient than with 1,10-phenanthroline although here, too, residual lignin content is reduced significantly. At the same time pulp viscosity is much less affected with 4-methyl-1,10-phenanthroline. The combined effect of brightening, delignification and protection of viscosity was an unexpected achievement and will contribute considerably to improve fiber quality.

TABLE 11

| | T57 | T58 | T59 | T60 | T61 | T62 | T63 | T64 | T65 |
|---|---|---|---|---|---|---|---|---|---|
| Temperature [° C.] | 90 | 90 | 90 | 90 | 90 | 90 | 90 | 90 | 90 |
| Time [min] | 180 | 180 | 180 | 180 | 180 | 180 | 180 | 180 | 180 |
| $MgSO_4$ [%] | — | — | — | — | — | — | — | — | — |
| NaOH [%] | 1.5 | 1.5 | 1.5 | 1.5 | 1.5 | 1.5 | 1.5 | 1.5 | 1.5 |
| $H_2O_2$ [%] | 4 | 4 | 4 | 4 | 4 | 4 | 4 | 4 | 4 |
| 4-methylene-1,10-phenanthroline [%] | — | 0.025 | 0.05 | 0.1 | 0.15 | — | — | — | — |
| 1,10-phenanthroline [%] | — | — | — | — | — | 0.025 | 0.05 | 0.1 | 0.15 |
| Brightness [% ISO] | 69.6 | 80.5 | 82.4 | 81.0 | 85.2 | 75.1 | 77.1 | 78.1 | 79.0 |
| $H_2O_2$ at end of reaction [%] | 44.2 | 11.9 | 13.6 | 2.1 | 2.1 | 25.1 | 22.5 | 19.1 | 15.7 |
| Viscosity [ml/g] | 737 | 672 | 636 | 573 | 538 | 659 | 633 | 591 | 555 |
| Kappa number [–] | 5.1 | 4.3 | 4.0 | 3.7 | 3.5 | 4.6 | 4.3 | 4.1 | 3.9 |

TABLE 10-2

| | T53 | T54 | T55 | T56 |
|---|---|---|---|---|
| Temperature [° C.] | 120 | 120 | 120 | 120 |
| Time [min] | 90 | 90 | 90 | 90 |
| $MgSO_4$ [%] | — | — | — | — |
| NaOH [%] | 1.5 | 1.5 | 1.5 | 1.5 |
| $H_2O_2$ [%] | 4 | 4 | 4 | 4 |
| 3,4,7,8-tetramethylene-1,10-phenanthroline [%] | — | — | — | — |
| 1,10-phenanthroline [%] | — | — | — | — |
| 2,2'-bipyridyle | 0.025 | 0.05 | 0.1 | 0.15 |
| Brightness [% ISO] | 77.7 | 79.3 | 80.0 | 80.5 |
| $H_2O_2$ at end of reaction [%] | 16.2 | 12.8 | 7.7 | 6.4 |
| Viscosity [ml/g] | 576 | 550 | 510 | 489 |

EXAMPLE 11

Peroxide Bleaching of a Pretreated Kraft Spruce Pulp

The Kraft spruce pulp and the pretreatment conditions are the same as described in Example 10. Table 11 shows reaction conditions and results of peroxide bleaching.

EXAMPLE 12

Repeated use of Activating Additive

In Example 12, a spruce Kraft pulp was bleached with a total chlorine free bleaching sequence. Following an oxygen delignification and a chelation treatment, an oxygen-hydrogen peroxide (OP) stage was conducted. Reaction time was either 240 min (T 66; OQ(OP)1) or 300 minutes (T69; OQ(OP)2). The (OP) stage was conducted in the presence of an activating additive, i.e. 1,10-phenanthroline (phen=0.05%). Final peroxide bleaching (P) was conducted without activating additive (T67, T68; T70, T71) or with activating additive (T72, T73). Further, the effect of a stabilizing compound was tested (T74, T75; NTA=nitrilotriamine acid). Surprisingly, the addition of an activating additive (T72, T73) led to an improved final brightness of the pulp although the same activating additive had already been used in the same bleaching sequence in an earlier stage. Even minor amounts (0.025% based on bd pulp) show a significant increase of brightness. Addition of NTA neither improved brightness nor delignification. However, residual hydrogen peroxide content of the bleaching solution was improved.

TABLE 12

| Bleaching sequence | No. of trial | time [min] | Temp. [° C.] | $H_2O_2$ [%] | NaOH [%] | $MgSO_4$ [%] | phen [%] | NTA [%] | pH start | pH end | residual $H_2O_2$ [%] | Kappa number [–] | Brightness [% ISO] | Viscosity [ml/g] |
|---|---|---|---|---|---|---|---|---|---|---|---|---|---|---|
| OQ(OP) | T 66 | 240 | 90 | 3.0 | 2.0 | 0.1 | 0.05 | — | 11.3 | 11.2 | 44.2 | 3.5 | 83.5 | 643 |
| OQ(OP)1 P | T 67 | 180 | 90 | 1.0 | 1.5 | 0.1 | — | — | 11.7 | 11.5 | 35.7 | 2.8 | 86.0 | 620 |
| OQ(OP)1 P | T 68 | 180 | 90 | 2.0 | 1.5 | 0.1 | — | — | 11.7 | 11.6 | 62.9 | 2.7 | 87.2 | 595 |
| OQ(OP) | T 69 | 300 | 90 | 3.0 | 2.0 | 0.1 | 0.05 | — | 11.3 | 11.0 | 43.0 | 3.4 | 85.0 | 625 |
| OQ(OP)2 P | T 70 | 180 | 90 | 1.0 | 1.5 | 0.1 | — | — | 11.7 | 11.5 | 34.0 | 2.7 | 86.2 | 590 |
| OQ(OP)2 P | T 71 | 180 | 90 | 2.0 | 1.5 | 0.1 | — | — | 11.7 | 11.6 | 45.9 | 2.6 | 87.5 | 553 |
| OQ(OP)2 P | T 72 | 180 | 90 | 1.0 | 1.5 | 0.1 | 0.025 | — | 11.7 | 11.6 | 23.8 | 2.6 | 87.8 | 552 |
| OQ(OP)2 P | T 73 | 180 | 90 | 2.0 | 1.5 | 0.1 | 0.025 | — | 11.7 | 11.5 | 41.7 | 2.6 | 88.3 | 533 |
| OQ(OP)2 P | T 74 | 180 | 90 | 2.0 | 1.5 | 0.1 | — | 0.1 | 11.7 | 11.6 | 45.9 | 2.6 | 87.7 | 557 |
| OQ(OP)2 P | T 75 | 180 | 90 | 2.0 | 1.5 | 0.1 | — | 0.3 | 11.7 | 11.6 | 62.0 | 2.7 | 87.0 | 591 |

5 g bd fibers per batch, consistency: 10%, pressure: 0.8 MPa $O_2$ phen = 1,10-phenanthroline V 66/OQ parameters of spruce Kraft pulp after oxygen delignification and chelation, but prior to bleaching:
Kappa no. 8.2; Viscosity: 825 ml/g; Brightness: 45.1% ISO
O = oxygen stage; Q = chelation; (OP) = oxygen stage with addition of hydrogen peroxide residual hydrogen peroxide content here is calculated on 100% hydrogen peroxide input

What is claimed is:

1. A method of bleaching lignocellulosic fibers which comprises the step of treating the lignocellulosic fibers with a bleaching composition comprising at least one oxidizing bleaching agent in aqueous solution in the presence of at least one additive which activates delignification or bleaching wherein the activating additive is a phenanthroline selected from the group consisting of 2,9-dimethyl-1,10-phenanthroline, 2,9-dimethyl-4,7-diphenyl-1,10-phenanthroline, 2,9-dimethyl-4,7-diphenyl-1,10-phenanthroline-disulfonic acid-disodium salt-hydrate, and 3,4,7,8-tetramethyl-1,10-phenanthroline.

2. The method of bleaching lignocellulosic fibers defined in claim 1 wherein the oxidizing bleaching agent is ozone, a peroxo chemical or mixtures thereof.

3. The method of bleaching lignocellulosic fibers defined in claim 2 wherein the peroxo chemical is hydrogen peroxide, sodium peroxide, a perborate, performic acid, peracetic acid or caroic acid or a salt thereof.

4. The method of bleaching lignocellulosic fibers defined in claim 1 wherein two activating additives are employed.

5. The method of bleaching lignocellulosic fibers defined in claim 1 wherein the amount of activating additive ranges from 0.001 to 5.0% of the lignocellulosic fiber bone dry.

6. The method of bleaching lignocellulosic fibers defined in claim 5 wherein the amount of activating additive ranges from 0.01 to 1.0% of the lignocellulosic fiber bone dry.

7. The method of bleaching lignocellulosic fibers defined in claim 1 wherein the amount of oxidizing bleaching agent ranges from 0.1 to 15.0% of bleaching composition based on the lignocellulosic fibers bone dry.

8. The method of bleaching lignocellulosic fibers defined in claim 1 wherein bleaching is conducted under acidic, neutral or alkaline conditions.

9. The method of bleaching lignocellulosic fibers defined in claim 1 wherein the pH of the aqueous solution ranges from 8 to 13.5.

10. The method of bleaching lignocellulosic fibers defined in claim 1 wherein the consistency of the solution ranges from 0.5 to 50% of bone dry lignocellulosic fiber based on water.

11. The method of bleaching lignocellulosic fibers defined in claim 1 wherein the temperature during treatment ranges from 20 to 130° C.

12. The method of bleaching lignocellulosic fibers defined in claim 1 wherein time of treatment ranges from 5 to 420 minutes.

13. The method of bleaching lignocellulosic fibers defined in claim 1 wherein alcohol is added to the aqueous solution.

14. The method of bleaching lignocellulosic fibers defined in claim 1 which further comprises the step of adding at least one stabilizing compound to the aqueous solution.

15. The method of bleaching lignocellulosic fibers defined in claim 1 wherein the stabilizing compound is selected from the group consisting of: poly-alpha-hydroxy acrylic acid, phosphonic acid, polyaminocarboxylic acid, nitrilotriacetic acid, salicylic acid, salts of these acids or an oxy or polyoxy compound with 2 to 7 carbon atoms in their carbon atom chain, a magnesium compound or sodium silicate.

16. The method of bleaching lignocellulosic fibers defined in claim 1 wherein the activating additive and the stabilizing compound are mixed as an aqueous or aqueous alkanol mixture and that this mixture is added to the solution of lignocellulosic fibers, water and bleaching composition.

17. The method of bleaching lignocellulosic fibers defined in claim 16 wherein the mixture of activating additive and stabilizing compound is added prior, after or together with the applied bleaching compound.

18. The method of bleaching lignocellulosic fibers defined in claim 1 wherein the bleaching is carried out in a multi-stage process and wherein the activating additive is applied to at least two different stages of the bleaching sequence.

* * * * *